United States Patent [19]

Haggerty

[11] 4,023,800

[45] May 17, 1977

[54] TENNIS RACKET CASE

[76] Inventor: Patrick E. Haggerty, 3411 E. Kiest Blvd., Dallas, Tex. 75203

[22] Filed: Mar. 30, 1976

[21] Appl. No.: 672,260

[52] U.S. Cl. ..... 273/74; 150/52 G; 206/315 R

[51] Int. Cl.[2] ..... A63B 49/18; B65D 85/00

[58] Field of Search ..... 273/74; 150/52 G, 52 R; 206/470, 315

[56] References Cited

UNITED STATES PATENTS

| | | | |
|---|---|---|---|
| 2,134,411 | 10/1938 | Marx | 273/74 X |
| 3,943,989 | 3/1976 | Sperling | 273/74 X |

FOREIGN PATENTS OR APPLICATIONS

| | | | |
|---|---|---|---|
| 724,004 | 4/1932 | France | 273/74 |
| 342,412 | 2/1931 | United Kingdom | 150/52 G |
| 426,542 | 4/1935 | United Kingdom | 273/74 |

*Primary Examiner*—Richard J. Apley
*Attorney, Agent, or Firm*—Howard E. Moore; Gerald G. Crutsinger

[57] ABSTRACT

A case for carrying a tennis racket and balls comprising first and second sides hingedly secured along a flat surface on which the case may be rested and a ball pocket extending outwardly from one of the sides having a flat foot-like surface to support the case in a vertical position when the case is closed and to support the side from which the foot extends in a vertical position when the case is opened.

7 Claims, 6 Drawing Figures

TENNIS RACKET CASE

BACKGROUND

Cases heretofore developed to hold tennis rackets and balls have not had any means to support the case on its edge in a vertical position. Therefore, the case out of necessity had to be stored flat. A tennis racket is a very delicate instrument which is quite sensitive to the weather and the position which it is stored due to the strain on the frame of the tennis racket from the strings which are attached thereto.

When placed in a flat position the tennis racket is more vulnerable to warpage and to injury due to placing something on the flat surface of the string area than if the racket is stored on its edge. Even the more modern day rackets made of steel and aluminum alloys are vulnerable to damage to the surface of the string area when stored in a flat position.

Cases heretofore devised to protect the tennis racket have involved elaborate press frames which are bulky and cumbersome to use and do not allow ready access to the tennis racket without removing or loosening screws.

SUMMARY OF THE INVENTION

My invention is a tennis racket case which may be readily set in a vertical position, thereby storing the tennis racket on the edge of the oval head. The tennis racket case comprises first and second side members which are hingedly secured along a flat edge of the side members and having a zipper to close the side members. One of the side members has a ball pocket extending therefrom forming a foot which has a flat surface parallel to the flat surface of the hinge member and lying in approximately the same plane therewith such that the tennis case may be set upon the flat surface where it will readily stand in a vertical position, storing the tennis racket on its edges. The foot-like member also serves to hold that side in a vertical position when the tennis racket case is opened making the tennis racket and the balls in the case readily accessible while occupying a minimal space on the tennis court.

The primary object of the invention is to provide a tennis racket case having a foot thereon to aid in storing the tennis racket in a vertical position on one of its edges.

A further object of the invention is to provide a foot on one of the sides of the tennis racket case to maintain that side in a vertical position when the case is opened and closed.

Another object of the invention is to provide a case for storing the tennis racket while in transit which provides a maximum of protection to the weather and elements surrounding the tennis racket.

Other and further objects of the invention will become apparent upon reading the detailed description and referring to the drawing annexed hereto.

DESCRIPTION OF THE DRAWINGS

Drawings of a preferred embodiment of the invention are annexed hereto so that the invention may be better and more fully understood, in which.

Numeral references are employed to designate parts shown in the drawings and like numerals designate like parts throughout the various figures of the drawing.

DESCRIPTION OF A PREFERRED EMBODIMENT

The numeral 10 generally designates the tennis racket case illustrated in FIGS. 1 through 6.

Figure 1:
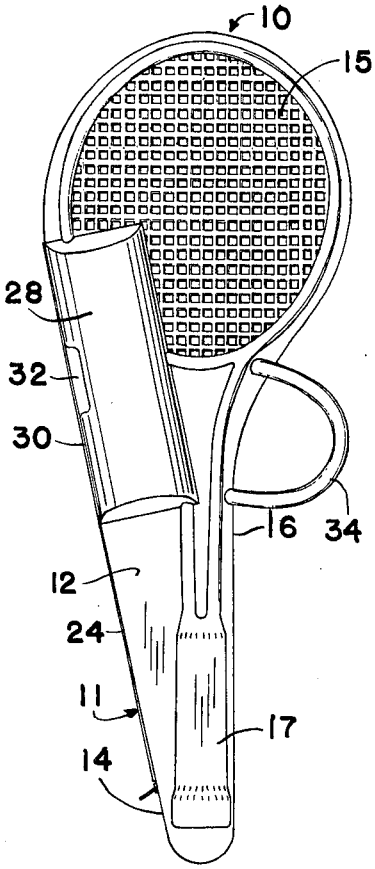
FIG. 1 is a side elevational view of the tennis racket case.
Figure 2:
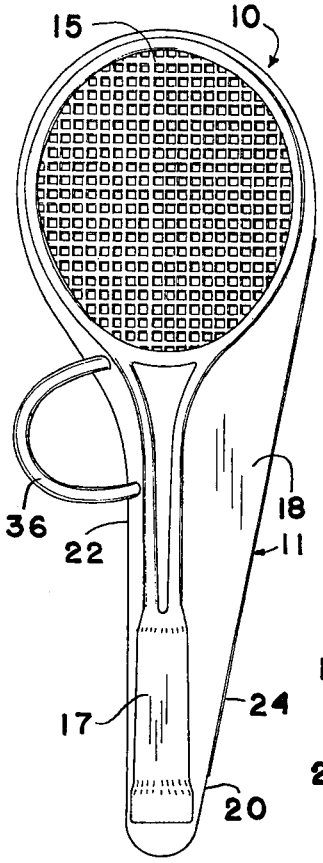
FIG. 2 is a side elevational view of the opposite side from FIG. 1.
Figure 3:
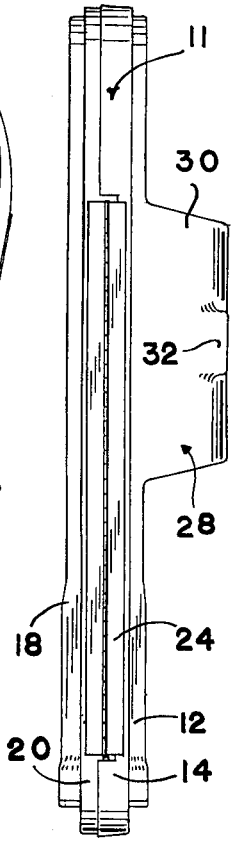
FIG. 3 is a bottom plan view of the tennis racket case.
Figure 4:
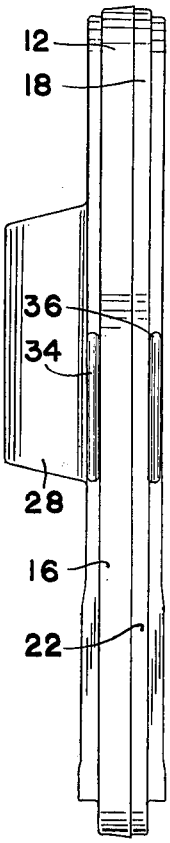
FIG. 4 is a top plan view of the tennis racket case.

A first side member 12 of the tennis racket case 10 is illustrated in FIG. 1 of the drawing, comprising flattened edge 14 and an upper edge 16. The second side member 18, illustrated in FIG. 2 comprises a flat edge 20 and an upper edge 22. Means is provided to secure first and second side members 12 and 18 together along flat edges 14 and 20 such as a hinge member 24, best illustrated in FIG. 3 to form lower flat edge 11.

Figure 5:
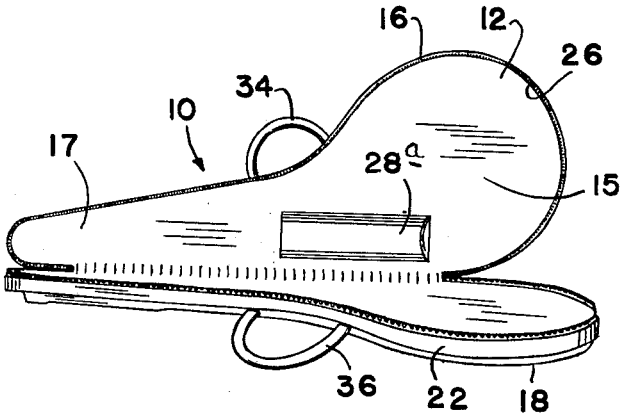
FIG. 5 is a perspective elevational view of the tennis case in open position.
Figure 6:
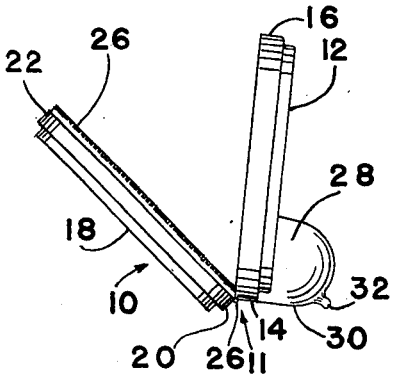
FIG. 6 is an end view of the partially opened tennis racket case.

Means is provided to secure the upper edges 16 and 22 of side members 12 and 18 such as zipper 26 best illustrated in FIGS. 5 and 6.

It should be noted that the upper edge 16 of side member 12 overlaps upper edge member 22 of side member 18 to provide protection to the zipper 26 when the tennis racket case 10 is closed. From the foregoing it should be readily apparent that upper edge 16 is of flexible material to permit unzipping of zipper 26.

Side members 16 and 18 are preferably constructed of a light weight flexible or rigid material such as polyvinyl plastic or the like, and protect the tennis racket (not shown) stored therein from dampness. Side members 12 and 18 have an accurate head 15 and a tapered handle region 17 shaped to accept the head and handle of a tennis racket (not shown).

Side member 12 has a hollow foot member 28 extending therefrom, having a flat edge 30 formed in a plane parallel to flat edges 14 and 20 when the case is in closed position. The flat edge 30 has an extension 32 formed in the same plane parallel to edge 30 to provide a flat surface which coincides with flat edges 14 and 20 of case 10 such that when the case is set on same, the foot member 28 maintains the case 10 in a vertical position.

The foot member 28 preferably provides a hollow pocket **28*a* formed in side 12 such that tennis balls may be placed therein for storage and carriage as best illustrated in FIG. 5.**

Each of side members 12 and 18 are provided with means to grip and carry case 10 such as handles 34 and 36 secured to each side respectively, which are centrally located for easy carrying.

Each of said side members 12 and 18 are preferably lined with a padding material to protect the tennis racket from shock during transit such as a synthetic lamb's wool or foam rubber.

From the foregoing it should be readily apparent that when the tennis racket case 10 is placed on the flat edge 11, corresponding to flat surfaces 14, 20 and 30 the foot member 28 balances the racket case 10 such that side members 12 and 18 are in vertical position, storing the tennis racket (not shown) contained therein on its edge. It should be readily apparent that without the foot member 28 and foot extension 32 the tennis racket case 10 would be unable to balance on the narrow edge provided by flat surfaces 14 and 20 and could easily be tipped over.

When the zipper 26 is unzipped such that side members 12 and 18 may be separated as illustrated in FIG. 5, the foot extension 28 provides a flat surface 30 on which to support side member 12 in a vertical position, as side member 18 is moved to a flat position as illustrated in FIG. 6, such that the tennis racket (not shown) contained in the case would be readily accessible and maintained in a sidewise position. The foot extension 28 provides a hollow pocket 28*a* which when opened would make the tennis balls (not shown) which are stored therein readily accessible. As can be seen from the foregoing, when side member 12 is in the vertical position as the case 10 is opened about one half the space is occupied as would be the case if the side members 12 and 18 were lying in a single plane.

From the foregoing it should be readily apparent that the preferred embodiment accomplishes the objects of the invention hereinbefore discussed.

It should be appreciated that other and further forms of the invention may be devised without departing from the spirit and scope of the appended claims.

Having described my invention, I claim:

1. A tennis racket and ball carrying case comprising: a first side member having at least one flat edge extending along the length of one side thereof; a second side member having at least one flat edge extending along the length of one side thereof; means to pivotally join said first and second side members along correspondingly flat edges; means to disengageably join said side members to close same; ball carrying means comprising a hollow foot member extending outwardly from one of said side members, said foot member having a substantially flat surface formed in the same plane as said flat edges on said first and second side members such that when the case is positioned on the flat edges and flat surface the case will remain upright.

2. The combination called for in claim 1 with the addition of an extension from said foot member to extend the flat area of the tennis racket case.

3. The combination called for in claim 1 wherein means to disengageably join said side members comprises a zipper and a flexible flap attached to one of the side edges arranged to extend over said zipper to protect same.

4. The combination called for in claim 1 wherein said first and second side members have an arcuate head and a tapered handle region shaped to accept a tennis racket.

5. The combination called for in claim 1 wherein the foot member is hollow on the interior of said tennis racket case arranged to receive and store tennis balls.

6. The combination called for in claim 1 with the addition of handle means on the case.

7. A self supporting tennis racket and ball carrying case comprising: a first side member, said side member having an arcuate head portion and a tapered handle portion shaped to accept the racket, said side member further having a deflected edge, said deflected edge being substantially straight along the length of one side of the first side member; a second side member having an arcuate head portion and a tapered handle portion to accept the racket, said side member further having a deflected edge formed to engage the deflected edge of first side member and being substantially straight along the length of one side of the second side member; means to pivotally join said first and second side members along correspondingly substantially straight edges; means to close said side members; ball carrying means comprising a hollow foot member extending outwardly from the arcuate head region of one of the side members, the foot member having a substantially straight bottom surface which is aligned with the substantially straight edge of the first and second side members so as to extend the flat portion of the first and second side members for supporting the racket case when the case is placed upon the substantially straight edges of the case; and handle means attached to the racket case on the first and second side members opposite the substantially straight edge thereof.

* * * * *